United States Patent [19]

Somogyi

[11] 3,991,554

[45] Nov. 16, 1976

[54] WATCH CONSTRUCTION

[75] Inventor: Bela Somogyi, Costa Mesa, Calif.

[73] Assignee: Hughes Aircraft Company, Culver City, Calif.

[22] Filed: July 28, 1975

[21] Appl. No.: 599,798

[52] U.S. Cl. ..... 58/23 BA; 58/23 R; 58/33

[51] Int. Cl.[2] ..... G04C 3/00

[58] Field of Search ..... 58/23 R, 23 BA, 33, 58/52 R, 53, 55, 57, 59, 85.5, 88 R, 50 R

[56] References Cited

UNITED STATES PATENTS

| | | | |
|---|---|---|---|
| 3,778,999 | 12/1973 | Vuffray | 58/23 R |
| 3,838,568 | 10/1974 | Zurcher et al. | 58/23 R X |
| 3,846,971 | 11/1974 | Ho et al. | 58/23 R |
| 3,861,135 | 1/1975 | Seeger, Jr. et al. | 58/50 R |
| 3,905,666 | 9/1975 | Grimm et al. | 58/23 R X |

*Primary Examiner*—Stanley J. Witkowski

*Attorney, Agent, or Firm*—Allen A. Dicke, Jr.; William H. MacAllister

[57] ABSTRACT

Watch module comprises electronic substrate carrying electronic logic devices, connections and display. Spacer is clamped against the substrate for holding the batteries and making connection therewith. Openings in spacer contain contacts in the form of conductive resilient material such as metal powder synthetic rubber which contacts electronics on the substrate and is contactable for control of the electronics.

7 Claims, 2 Drawing Figures

WATCH CONSTRUCTION

BACKGROUND OF THE INVENTION

This invention relates to the construction of an electronic watch, and particularly to the manner in which the circuitry on a watch substrate is connected and controlled within a watch case.

An electronic watch is one in which time increments are generated at a frequency in the order of kilocycles to megacycles per second, with dividers and memories for electronic time information processing. Readout is conveniently digital so that there are usually no movable mechanical parts except for switches to control the electronics. In recent years, there have been many inventions in electronic watches and many of the patents describe at least a portion of the physical constructions which interrelate the physical and electronic components. Pertinent background patents include McCullough et al. U.S. Pat. No. 3,759,031, Perkins et al. U.S. Pat. No. 3,784,725, Doss U.S. Pat. No. 3,846,972 and Yamazaki U.S. Pat. No. 3,800,523. These patents are just a few in the large body of prior art in the electronic watch and related field and are offered as examples of patents which disclose some of the physical structure of electronic watch construction.

More recent background patents which show electronics and structure which more closely relate to the present watch are Moyer U.S. Pat. No. 3,851,189 and Zurcher and Merles U.S. Pat. No. 3,838,568. Additionally, a particular watch module in which the present invention can be employed is shown in Zurcher, Somogyi and Burke application Ser. No. 563,927, filed Mar. 31, 1975 and assigned to the common assignee. The disclosure of each of these cross-referenced patents and application is incorporated herein in its entirety by this reference.

In order to be economically competitive, the modern electronic watch must have a minimum number of parts, must be economically assembleable and must be reliable. This invention defines a structure by which these desirable features can be achieved.

SUMMARY OF THE INVENTION

In order to aid in the understanding of this invention it can be stated in essentially summary form that it is directed to an electronic watch construction, and particularly a construction in which an electronic substrate has a conductive elastomer in contact with the electronics thereon for contact for control of the watch electronics.

It is thus an object of this invention to provide an electronic watch construction which is convenient and economic to manufacture and assemble and provides a reliable and trouble free electronic watch.

It is a further object to provide an electronic watch wherein electric connections to the substrate are accomplished at least in part by conductive elastomeric members which resiliently engage onto an electric conductor thereon for convenient assembly and repair.

It is a further object to provide an electronic watch module comprised of a substrate having watch electronics and display thereon, and a spacer clamped to the substrate with the conductive elastomeric member in contact with circuitry on the substrate and available for control contact so that the watch module can be controlled.

Other objects and advantages of this invention will become apparent from the study of the following portion of the specification, the claims and the attached drawings.

DESCRIPTION

Figure 1:
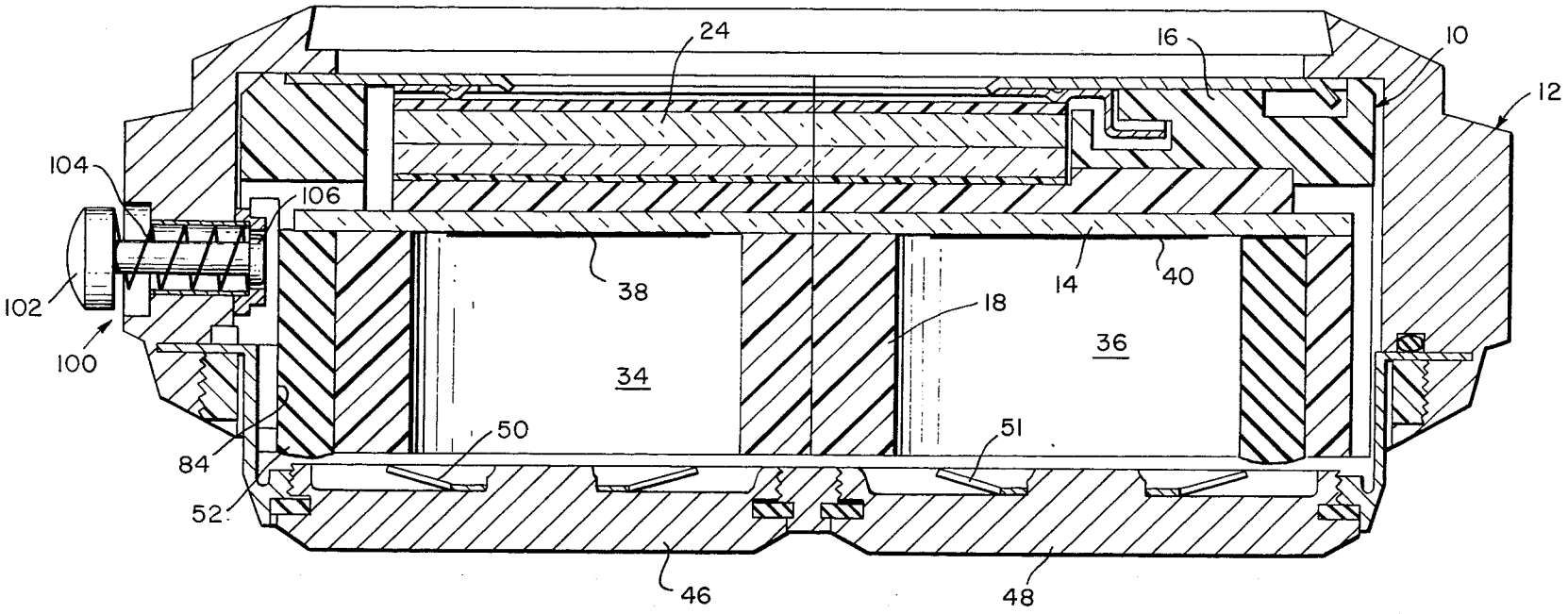
FIG. 1 is a section through a watch module having the conductive elastomeric contact member of this invention.

FIG. 1 shows the construction of watch module structure 10 of this invention in watch case 12. Watch module structure 10 includes substrate 14 clamped between top spacer 16 and rear spacer 18.

Substrate 14 is the principle carrier of the electronics and electrical interconnections of the electronic watch module. Substrate 14 is preferably a ceramic substrate for its dimensional stability, rigidity and insulation value. Printed circuitry is printed on the face thereof together with electronic watch components carried on the face and connected to the circuitry. The quartz crystal of the watch module is positioned at the back of substrate 14 and is electrically connected at pads which are connected to the integrated circuitry on the top of substrate 14.

In order to be effective, the substrate circuitry must be supplied with power, must be controllable and must have a useful display. Power is supplied by batteries which are positioned in battery pockets 34 and 36 in bottom spacer 18. Battery pads 38 and 40 are formed on the back of the substrate and are connected to the front by the usual vias. Elastomeric conductors in the form of perforated discs can be positioned between the batteries and the battery pads. These elastomeric conductors are used for electrical connection and spreading mechanical shock from the battery across a larger area of the substrate to help protect the substrate against damage. For further reference to this construction, attention is called to patent application Ser. No. 563,927 filed Mar. 31, 1975 for Electronic Watch Construction. The batteries are accessible for replacement through battery hatches 46 and 48 through the back of the case. Battery contact force can be maintained by battery springs 50 and 51, but if the elastomeric conductors are arranged for sufficient resilient displacement, the battery springs can be eliminated.

In the control of the electronics on the substrate, switching is required. Switching is for the purpose of choosing particular information to be shown on display 24, for example, choosing an hours-minutes time display, a seconds display or a month-day display, whether or not the optical display device is a light emitting diode or a liquid crystal display. Also, control is required for the setting of the watch. Electric signals to the electronics in the watch are accomplished by manually operable electric switches. The section through the watch case in FIG. 1 is a section through the push button switch 100 in association with conductive elastomeric contact member 52. Similar push button switches are in association with conductive elastomeric contact members 54 and 56 (see FIG. 2). When one of the contact members is in association with circuitry employed in resetting the horological memory, its associated pushbutton contact may be recessed so that it is not inadvertently depressed, in order to maintain the memory. The push buttons each connect the potential of the case to the corresponding contact member which are connected by adjacent pads on the back of the substrate to the electronic circuitry.

Each of the conductive elastomeric contact members 52, 54 and 56 which are in the watch module and are contactable by push buttons in the watch case, and conductive elastomeric contact member 58 which contacts the side of a battery in battery well 36 is made of the same material. The material is elastomeric, and is preferably a synthetic polymer composition elastomer of such nature that it resists change in character by aging. Each of the members contains metal powder in sufficient concentration to cause the members to be electrically conductive, rather than insulative. As a specific example, the elastomeric material of the members is silicon rubber, and the elastomer is loaded with silver powder to a concentration such as to provide a resistance below 1 ohm centimeter, for instance of 0.009 ohm centimeters.

Figure 2:
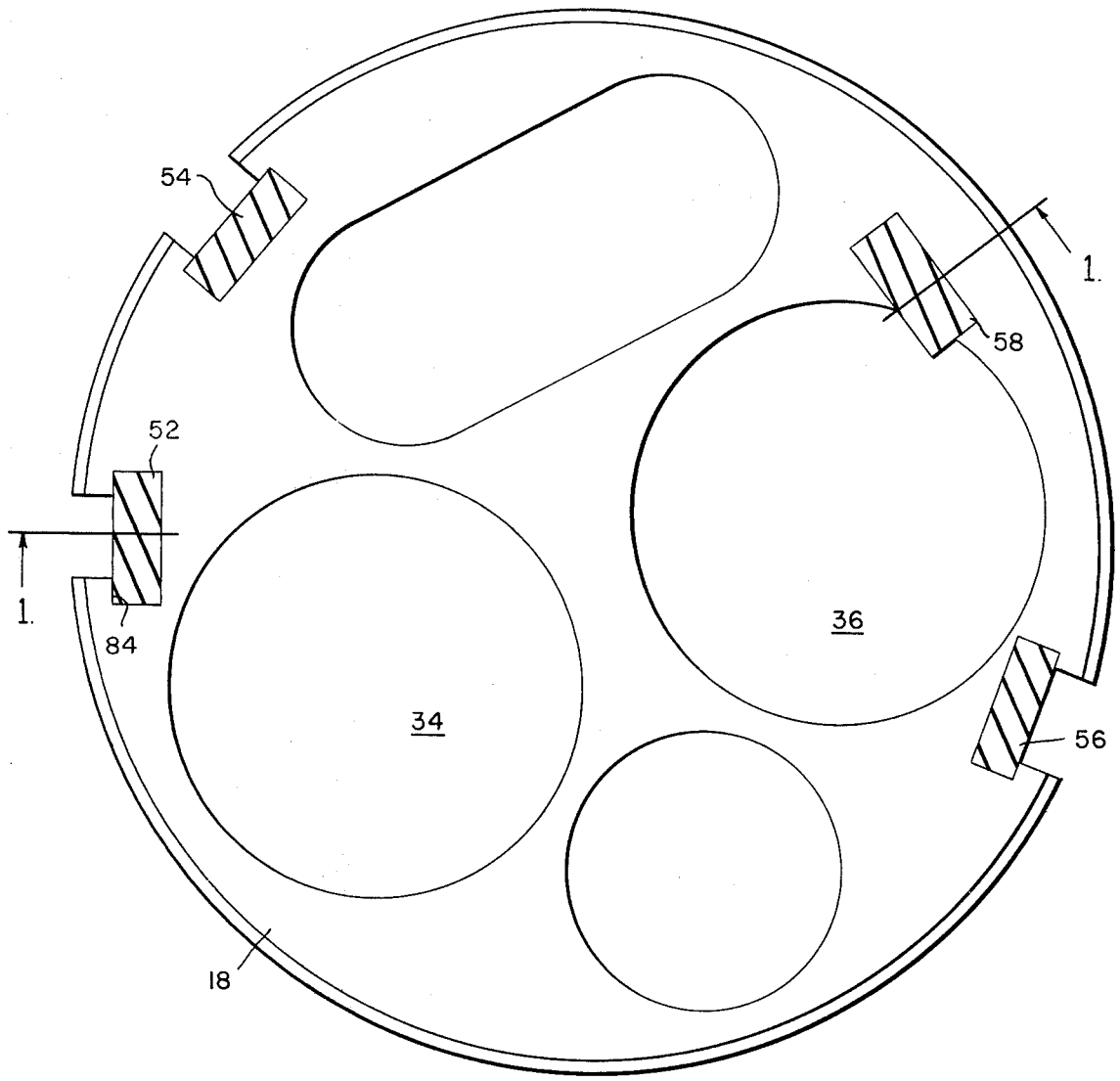
FIG. 2 is a plan of the lower spacer of the watch module taken generally along line 2—2 of FIG. 1.

As is seen in FIG. 2, each of the members is inserted into an opening or slot adjacent the edge and open to the edge of lower spacer 18 so that it is restrained in the lower spacer. In the case of members 52, 54 and 56, they are each accessible by a push button and thus the slots in which the members are inserted are T slots. As is seen in FIG. 1, member 52 engages against T slot shoulder 84, which permits access to the member but restrains the member in place. In the case of member 58, it is inserted in a slot which intersects with the battery recess 36 so that contact with the battery case voltage is achieved. That voltage is the same voltage as the watch case.

Each of the members 52, 54, 56 and 58 is positioned to extend slightly above the upper face of rear spacer back 18 so that when the back of substrate 14 is clamped onto upper face of the spacer, the upper ends of each of the members is firmly clamped against the back side of the substrate. In each instance, the back side of the substrate at that location has a contact pad thereon which is contacted by the corresponding conductive elastomeric contact member. Thus, economic but positive electric contact is achieved from the contact member onto electronics on the substrate.

FIG. 1 illustrates pushbutton 100 which is slidably mounted in case 12. Button pad 102 is manually accessible and is urged toward the extended position by spring 104. Pushbutton contact 106 is thus spring urged to a position where the contact 106 is between the sidewalls of the T slot and does not extend through to shoulder 84 and thus push button contact 106 is out of contact with the conductive elastomeric contact member 52. Manual depression of button 102 moves contact 106 to be extended into electrical contact with contact member 52. The watch case 12 potential is intermediate the potential of battery pads 38 and 40. When the push button engages the case voltage onto contact member 52, that circuit on the substrate is connected to a potential between the potential of pads 38 and 40. This potential is fed as input information for controlling the logic. Similarly, contact members 54 and 56 are also connected to contact pads which are also connected to the substrate circuitry. Manually operable push buttons are positioned in the case to contact each of these contact members for various control modes of the electronics.

This invention having been described in its preferred embodiment, it is clear that it is susceptible to numerous modifications and embodiments within the ability of those skilled in the art, and without the exercise of the inventive skill. Accordingly the scope of this invention is defined by the scope of the following claims.

What is claimed is:

1. An electronic watch construction comprising:

a substrate having a face and having a back, said substrate being for carrying electronic watch components on the face thereof, at least one contact pad on the back of said substrate connected to the electronics on the face of said substrate;

a rear spacer block having an edge and having an upper face and being clamped with its upper face substantially against the back of said substrate, an opening in said spacer block adjacent said edge and open to said edge and adjacent said contact pad on the back of said substrate;

a conductive elastomeric contact member comprised of a synthetic polymer composition elastomer containing finely divided metal in sufficient concentration to be electrically conductive in said opening in said spacer block so that it is accessible from said edge so that electric contact can be made thereto and extending above said face of said spacer block against said contact pad to resiliently engage said contact pad to maintain electrical contact therewith and to be engageable by a switch button through the edge opening on said rear spacer block to act as a switch contact for control of watch electronics.

2. The electronic watch construction of claim 1 wherein said finely divided metal is powdered metal and the resistance of said member is below 1 ohm centimeter.

3. The electronic watch construction of claim 2 wherein said metal is silver powder.

4. The electronic watch of claim 1 wherein said opening in said rear spacer block includes means for restraining said contact member for contact by a switch member which applies a voltage to said elastomeric contact member for control of watch electronics.

5. The electronic watch of claim 1 wherein said rear spacer block has a battery opening therein and said opening containing said conductive elastomeric contact member is open to said battery opening so that said elastomeric contact member is in resilient electrical contact with the case of a battery in said battery opening to supply battery case potential to said watch electronics.

6. The electronic watch of claim 5 wherein there is another opening in said rear spacer block which includes means for supporting another contact member for contact by a switch member which applies a voltage to said elastomeric contact member for control of watch electronics.

7. The electronic watch of claim 6 wherein said rear spacer block has an edge and said another opening is open to the edge of said rear spacer block so that contact with said elastomeric member can be obtained from the edge of said spacer.

* * * * *